United States Patent [19]

Skegin

[11] Patent Number: 4,882,667

[45] Date of Patent: Nov. 21, 1989

[54] VENTILATED MINIATURE LIGHTING FIXTURES

[76] Inventor: Maer Skegin, 1411 N. Poinsettia Pl., #206, Los Angeles, Calif. 90046

[21] Appl. No.: 196,287

[22] Filed: May 20, 1988

[51] Int. Cl.[4] ..... F21V 29/00

[52] U.S. Cl. ..... 362/373; 362/294; 362/345; 362/371; 362/408

[58] Field of Search ..... 362/294, 345, 373, 408, 362/307, 296, 362, 371

[56] References Cited

U.S. PATENT DOCUMENTS 2,287,328 6/1942 Rose ..... 362/373

2,307,302 1/1943 Richardson ..... 362/373

4,729,078 3/1988 Skegin ..... 362/373 X

*Primary Examiner*—Stephen F. Husar

*Attorney, Agent, or Firm*—Natan Epstein

[57] ABSTRACT

A housing for halogen lamps includes an extruded tubular segment with an axial bore, a lamp socket at one end of the bore and at least one pair of opposed longitudinal ventilation slots opening into the bore. The ventilation slots are shielded by an internal baffle which allows air flow across the bore but closes the interior of the housing to view through the slots. A power transformer unit may be included in the bore between the ventilation slots.

18 Claims, 4 Drawing Sheets

FIG. 8
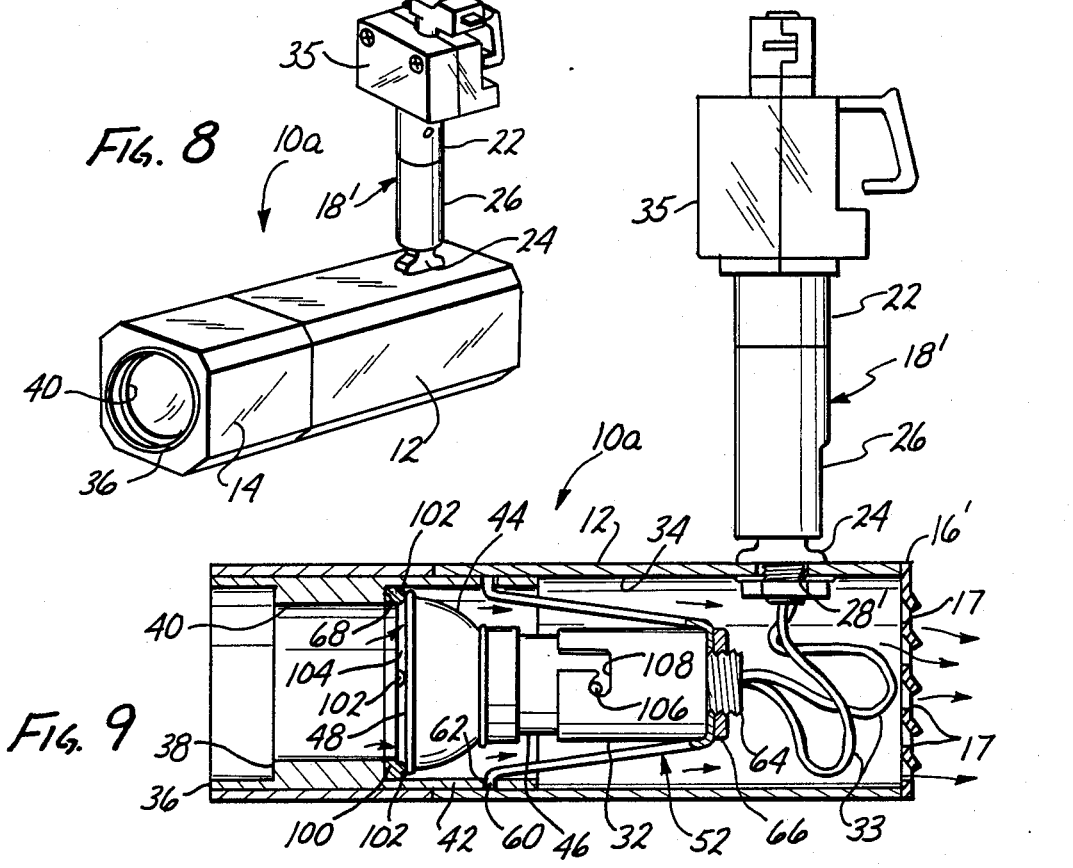
FIG. 9
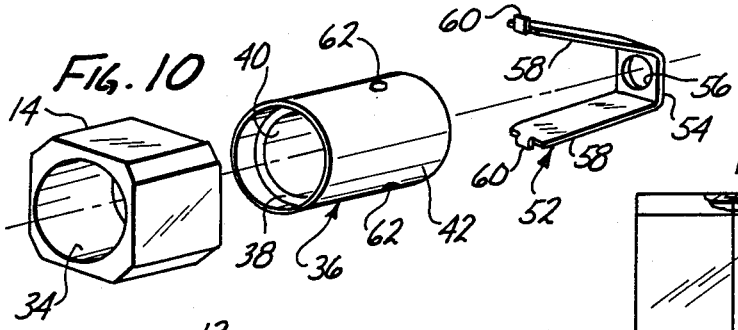
FIG. 10
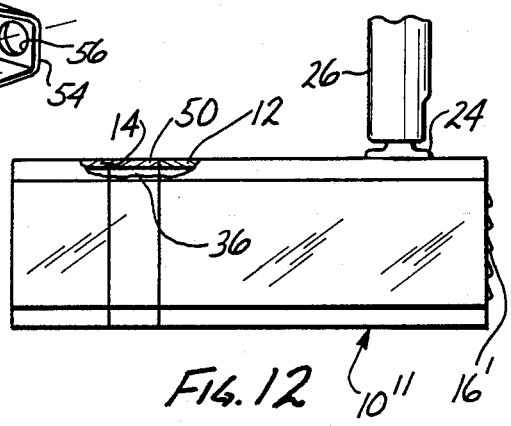
FIG. 12
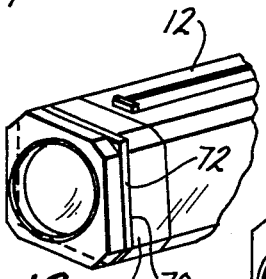
FIG. 13
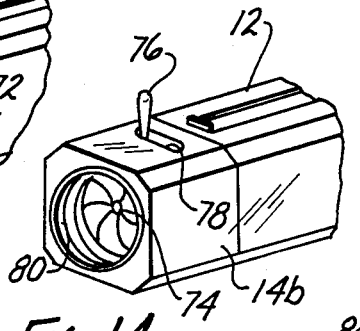
FIG. 14
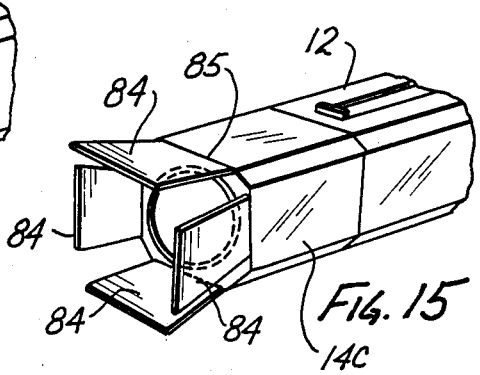
FIG. 15

10
12a
18''
28'
24
16''
14
44
27
40
48
102
104
33d
33c
38
36
100
102
52
34
32
120
110
122

96
15
10
92
34
36
12
92
15
96

34
12
110
112
112

15
12c
15
34
92
15
92
15

VENTILATED MINIATURE LIGHTING FIXTURES

BACKGROUND OF THE INVENTION

1. Field of the Invention

The present invention is directed to the field of interior lighting fixtures and more particular relates to compact or miniatuire size lamp housings or fixtures particularly useful for use with high intensity halogen miniature light sources.

2. State of the Prior Art

The current trend in interior lighting is away from the decades old, relatively bulky light bulbs using tungsten filaments in vacuum to more compact and efficient, brighter halogen light sources. The new halogen lamp bulbs are quite small in comparison and are suitable for use with small reflectors which greatly assist in directing the emitted light in a useful manner so that the most effective use can be made of the available light output. The high intensity halogen light sources are widely available in a series of standard sizes, configurations and power handling capabilities. A continuing need exists for lamp housings and fixtures particularly adapted to these new light sources. The need is for compact, even miniature housings of simple construction and easy assembly consistent with safe and reliable operation, especially fixtures for track mounting. Quality track light type fixtures currently on the market are costly and a particular need exists for attractive, durable miniature tract light housings of lower cost.

A recurring problem in existing miniature high intensity lighting fixture is the adequate dissipation of the intense heat generated by the halogen lamp within a small enclosure. This problem is intensified when the fixture is provided with a built-in power transformer which is necessary to step down the AC household line voltage to the low voltage required by the halogen bulb. Numerous lighting fixture designs exist with varying degrees of success in overcoming the heat dissipation problem. A trade-off is often necessary between proper ventilation of the fixture and the ornamental appearance of the same. In some designs, little ventilation is provided as a concession to the designer's esthetic expression while in others numerous vent openings and air flow paths are provided at the expense of appearance and frequently also allowing stray light to escape from within the lighting fixture through the vent apertures, which is an undesirable effect in directional lighting fixtures.

A continuing need for low-cost, attractive and effective compact and miniature track lighting fixtures exists, and particularly for such fixtures with or without built-in power transformers having improved heat dissipation and ventilation characteristics without sacrifice in ornamental appearance nor significant stray light leakage.

SUMMARY OF THE INVENTION

The novel light fixture comprises a tubular housing comprising two opposite ends with a socket for mounting a lamp at on of the ends. One or more longitudinal slots are defined in the housing and a side baffle element is supported within the housing so as to define an air flow path into the housing at each slot while shielding the slot against emission of stray light from within the housing.

Advantageously, the housing is comprised of at least two tubular segments including a main housing segment to which is affixed a fixture mount or swivel, and a baffle holder segment. The two segments are axially coupled by a baffle tube which has a portion fixed within the baffle holder segment and a portion which extends into and makes a friction fit within the main housing segment. The lamp socket is electrically connected to electric power conductors within the main housing segment associated with the fixture mounting, and a halogen lamp/reflector assembly is removably and operatively mounted in the socket. The reflector has a circular rim which is received within the baffle tube and held by the same against lateral movement. In one embodiment the socket the lamp socket is mounted to one end of a spacer, the opposite end of the spacer being affixed to a panel closing the rear end of the main housing segment. The spacer extends axially through the main housing segment so that the reflector rim lies outside the front end of the tube segment. When the tube segments are then joined axially by means of the aforementioned internal coupler tube inserted into the front end of the main housing section, the reflector rim is received within the coupler tube and closely held therein against lateral movement at the forward end of the bushing. The side baffles are supported together with the spacer to the rear end of the main housing segment. In a fixture having two slots diametrically opposed on the main housing segment, the side baffles may be provided by a U-shaped baffle strip having two legs and a base connecting the two legs. The lamp socket is supported at the forward end of the spacer, while the rear end of the spacer is fixed to a rear end panel closing the rear of the main segment. The side baffle strip legs have free ends bent outwardly and engaged in the corresponding slots thereby keeping the legs in shielding alignment with the slots. The coupler tube may be slotted for receiving the ends of the baffle strip legs when inserted into the main housing segment. The coupler tube and therefore the baffle segment affixed to it are held by the side baffles against rotation relative to the main housing segment about their common longitudinal axis, maintaining the two segments in proper cross-sectional alignment. The baffle strip legs may be spring loaded in an outward direction and configured so as to further frictionally engage the coupler tube and help retain the same to the main housing segment. Four-slotted housing segments may be similarly provided wherein the side baffles are provided by two U-shaped baffle strips crossed at their bases and suported axially within the housing segment bore.

In another embodiment, the socket is mounted by means of a spring mounting clip engaged to the baffle tube. The reflector rim is closely held within the baffle tube against movement and the socket together with the lamp/reflector assembly are easily removable by manually disengaging the spring clip from the baffle tube after the two housing segments have been separated. In this embodiment the main housing segment may also be slotted longitudinally to provide side vents, with each slot associated with a side baffle which may be one leg of one or more U-shaped baffle strips fixed to the rear end of the main housing segment.

A front ventialtion gap between the front baffle and the reflector rim may be created by interposing a spacer ring having a number of axial protuberances between these two elements. The ring takes advantage of the axial spring action inherent in bayonet lamp sockets of the type conventionally used with halogen lamps. The spacer ring drives the reflector/lamp assembly a short distance into the bayonet socket, opening a gap between the reflector and baffle through which air flow may occur between the interior of the fixture and the ambient atmosphere. A louvered or otherwise apertured rear end panel may be added to establish a longitudinal ventilation flow path through the housing. The spacer ring may be retrofitted in general on any lighting fixture characterized by a reflector supported against a front baffle by a socket or other means capable of yielding rearwardly to accomodate the spacer ring thereby to improve the ventilation and heat dissipation in that fixture.

A solid state power transformer of the type where active and passive electronic components are mounted on a printed circuit board may be fitted within the housing segment and supported on its electrically nonconductive edges transversely in the housing segment bore without other mounting hardware. Instead of the power transformer, an internal rechargeable battery pack may be fitted within the housing bore.

The lamp housings of the fixtures of this invention can be made simply by cutting a length of tubing into two segments. For this purpose, it is particularly advantageous to make the tubing by continuous extrusion so that tubing of many different external cross sections and dimensions can be easily extruded, with or without decorative detail such as longitudinal striping, grooves, reliefs, etc.

BRIEF DESCRIPTION OF THE DRAWINGS

FIG. 8 is a perspective view of a variant embodiment of the fixture of FIG. 1;

FIG. 9 is a longitudinal cross-section in elevation of the fixture of FIG. 8;

FIG. 10 is an axially exploded perspective illustration of the snap-in mounting clip arrangement of the fixture of FIG. 9;

FIG. 11 shows in elevational cross section a housing as in FIG. 9 but extended to accommodate an internal power transformer;

FIG. 12 shows primarily in side elevational perspective a housing as in FIG. 8 but provided with an intermediate ornamental housing segment between the main housing and the baffle segments;

FIG. 13 shows a housing as in FIG. 1 wherein the baffle segment has been slotted to admit a color gel light filter;

FIG. 14 shows a housing as in FIG. 1 wherein the baffle segment has been provided with a condenser lens and iris control for variable aperture spotlight effect;

FIG. 15 shows a housing as in FIG. 1 wherein the baffle segment carries a barn door arrangement for controlling the area illuminated by the fixture;

DETAILED DESCRIPTION OF THE PREFERRED EMBODIMENTS

Figure 1:
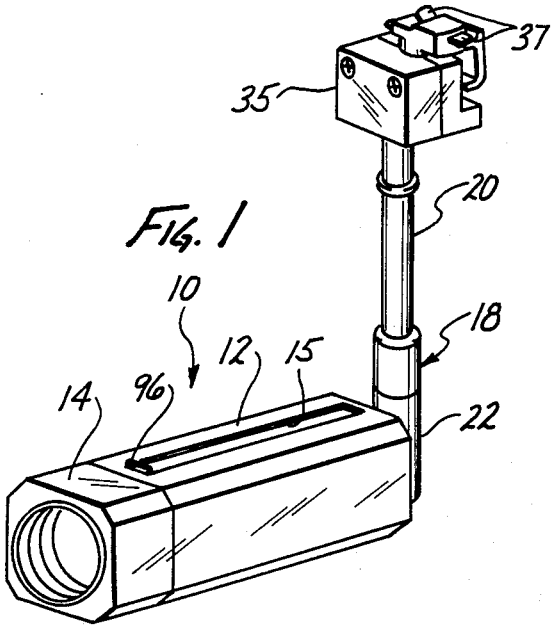
FIG. 1 is a perspective view of a typical slotted miniature lighting fixture according to this invention.
Figure 2:
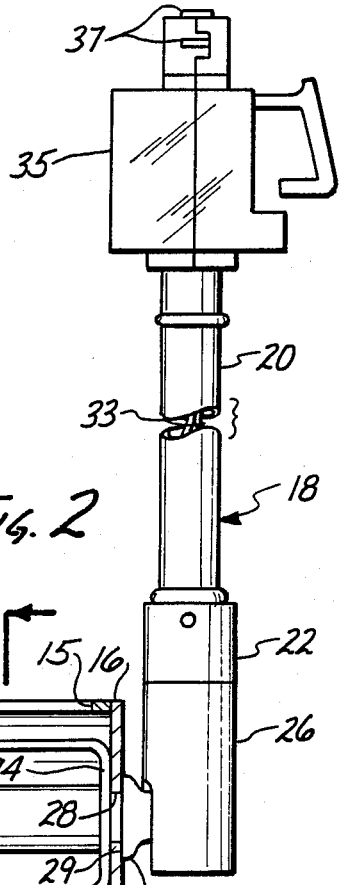
FIG. 2 is a longitudinal cross-section taken in elevation of the fixture of FIG. 1.

With reference to the drawings where like elements are designated by like numerals, FIG. 1 shows a lamp fixture 10 which includes a tubular main housing segment 12, a baffle holder segment 14 attached to the forward end of the tubular body 12 and a rear end panel 16 closing the opposite, rear end of the main housing segment 12, as best seen in the longitudinal section of FIG. 2. A fixture mounting 18 comprises a hollow rod 20 fixed to a swivel assembly 22 rotatable about the axis of rod 20 in the horizontal plane of FIG. 2. In turn, the swivel assembly 22 includes a threaded stub 24 pivoted to the body 26 for 90 degree movement in the vertical plane of the FIG. 2 drawings, between the illustrated right angle relationship between the rod 20 and lamp body 12 to a in-line position where the housing segment 12 is axially aligned with the mounting rod 20. The stub 24 is inserted through an opening 28 in the rear panel 16 and is threaded into a hollow spacer bushing 30, so that the rear panel 16 is tightly held in an interference fit between a shoulder 29 on the stub 24 and the rear end of the spacer 30. A lamp socket 32 is mounted at the free forward end of the spacer 30 and electrical conductors 34 are threaded from the socket 32 through the mounting rod 20, swivel body 26, threaded stub 24 and spacer bushing 30 for supplying electrical power from a suitable source of electrical power. The upper end of the mounting rod 20 may carry a standard track-light connector 35 adapted to slide along a conventional light track mounted to a ceiling or wall, with electrically conductive wiper contacts which draw electrical power from the track to the conductors 33. The swivel rod 20 may also be attached to a suitable supporting surface by means of a conventional canopy mount which in turn is mounted over an electrical outlet in a wall or ceiling surface, as is well known in the trade.

The main housing segment 12 is a tubular extrusion characterized by a cylindrical axial bore 34 and an outer cross-section which may be of any esthetically desirable shape, such as the soft-square cross section shown in the drawings. The baffle holder segment 14 is a shorter length of the same extrusion as that of segment 12, thus having the same inner and outer cross-sections and in particular, an axial bore 34 continuous with the axial bore 34 in the main section 12. The baffle holder 14 is attached to the forward end of the segment 12 by means of a baffle tube 36 with an outer diameter closely fitted to the diameter of extrusion bore 34, so that the baffle tube makes a snug sliding friction fit into the housing segment 12 as a bridging element connecting the baffle holder segment 14 to the main segment 12 as seen in FIG. 2. Preferably, the connecting baffle tube 36 is permanently fixed, as by means of an adhesive, to the baffle holder segment 14. The exposed portion 42 of the connecting tube 36 which extends rearwardly of the baffle holder 14 then fits into the forward end of the lamp tube bore 34 in a close-tolerance slide fit and is frictionally retained therein.

Figure 3:
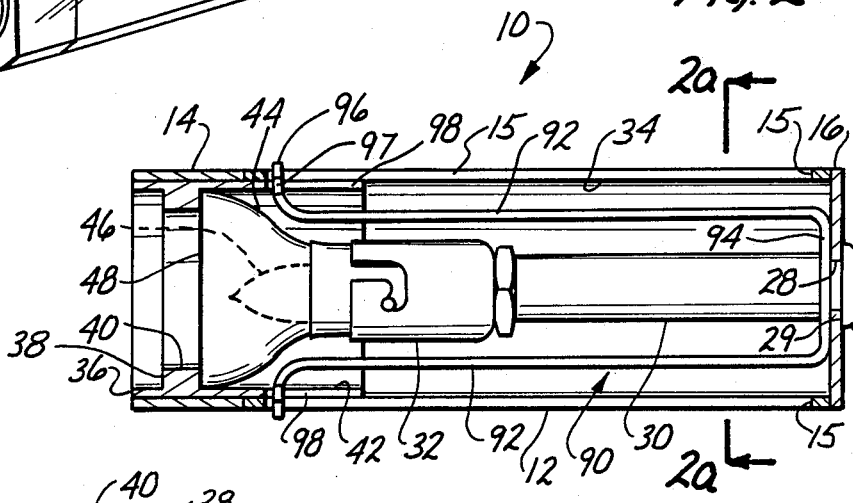
FIG. 3 is a front end view of the fixture of FIG. 1.
Figure 3:
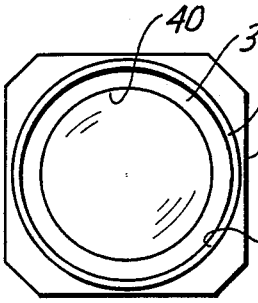

A commercially available light reflector 44/halogen high intensity incandescent miniature lamp 46 assembly is fitted to the socket 32 as shown in FIGS. 2 and 3. The reflector 44 has a circular rim 48 having a diameter slightly lesser than the inside diameter of the coupler tube portion 42, such that the reflector rim 48 slides into and is closely received within the baffle tube 36 when the same is fitted into the axial bore of the main housing segment 12. The reflector 44 and consequently the lamp socket 32 are thus held and supported within the coupler tube against lateral or radial movement within the housing segment 12 by virtue of the aforementioned close fit.

The coupler tube 36 is of constant external diameter but contains a fixed baffle 38 positioned immediately forward of the reflector rim 48 and defining a baffle aperture 40 of diameter smaller than the diameter of reflector rim 48 so as to hide the rim 48 from view and corresponding to the effective reflecting surface of the reflector 44. The baffle 38 may be machined integrally with the wall of a tube 36 or may be a separate element secured within the tube 36. The coupler tube 36 simplifies the construction and assembly of the light fixture by serving the multiple functions of axially joining the extrusion segments 12 and 14, supporting the reflector 44/lamp 46/socket 32 assembly against lateral movement such that the spacer bushing 30 is held securely at both of its ends, and holding the light baffle 38 in front of the reflector.

Figure 2A:
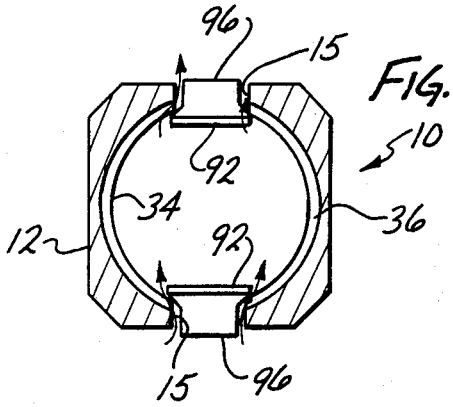
FIG. 2A is a cross-section taken along line 2A—2A in FIG. 2.

The housing segment 12 has two longitudinal slots 15 terminating short of either end of the housing segment 12 and diametrically opposite in the bore 34, i.e., on two opposite faces of the outer rectangular cross section of the housing segment 12 as best seen in the cross-section of FIG. 2A. A U-shaped baffle strip 90 best seen in FIG. 4, comprises a pair of generally parallel legs 92 connected at one end by a base segment 94 perforated by mounting hole 95 which is large enough to admit the threaded stub 24 of the swivel 22, but somewhat smaller than the diameter of spacer 30 such that the base 94 of the baffle strip 90 is held in an interference fit between the end panel 16 and the rear end of the spacer tube 30. The free end of each baffle strip leg 92 is bent outwardly at approximately a 90 degree angle to the leg, as best seen in FIG. 2, and is shaped to define an end tab 96. The width of each tab 96 is slightly smaller than the width of the ventilation slots 15 and normally each index tab 96 extends into a corresponding slot 15 to align each baffle leg 92 with its corresponding ventilation slot 15 and to hold the baffle strip 90 against rotation about the threaded stub 24. The tabs 96 keep the side baffles 92 spaced from the inside wall of the housing segment 12 as seen in FIG. 2A to define air flow paths suggested by the flow arrows for cross ventilation of the housing bore 32 while blocking stray light from escaping through the slots 15. The width of the side baffles 92 is somewhat greater than the width of the slots 15. The U-shape of the baffle strip 90 provides outward spring force tending to spread apart the free ends of the two legs 92 and thus to urge the index tabs 96 into the slots 15. The indexing tabs 96, however, can be readily pressed into the housing and out of the slots 15 for purposes of assembly or disassembly of the fixture. In the embodiment here illustrated the forward end of the slots 15 overlaps the portion 42 of the coupled tube 36 which is received within the forward end of the main housing segment 12 when the baffle segment 14 is assembled to the fixture. The coupler tube is therefore slotted longitudinally at diametrically opposed locations to a width equal to that of slots 15. The coupler tube 36 is mated to the main housing segment 12 by aligning the coupler tube slot 98 with the vent slots 15 of the housing segment 12 so that the index tabs 96 are received within the coupler tube slots 98 and do not obstruct insertion of the coupler tube into the housing segment 12. The index tabs 96 thus additionally serve to keep the coupler tube 36 from rotating within the bore 34 of the housing segment 12 and consequently keeps the baffle segment 14 in cross-sectional alignment with the housing segment 12, i.e., keeps the side faces and corners of each segment in continuous alignment and holds the two segments 12, 14 against relative rotation about their common axes. The height of the index tabs 96 may be further dimensioned to be such that the wider edge 97 on either side of the index tab at the end of the baffle leg 92 makes contact with the inner surface of the baffle tube 36 on either side of the slots 98, and under the outward spring tension of the baffle strip 90, this contact acts as a frictional retainer on the baffle tube 36 to further insure against its accidental separation from the housing segment 12.

The combined axial length of the spacer bushing 30, lamp socket 32 and lamp/reflector 44 is such that the reflector rim 48 lies exteriorly of the forward end of the main housing segment 12 as best understood from FIG. 2. After separation of the baffle holder 14 the reflector rim 48 is exposed and can be easily grasped to allow removal and exchange of the lamp 46 whenever necessary. This is accomplished by pulling axially on the baffle holder 14 until the coupler tube portion 42 is withdrawn and separates from the tubular body 12. The exposed reflector rim 48 projecting from the end of the housing tube 12 can be slightly pushed in and turned so as to disengage the reflector 44 and/or lamp 46 from the socket 32, and a replacement lamp inserted in its place, after which the baffle holder 14 is replaced by inserting the coupler tube portion 42 into the open forward end of the main housing bore 34 and over the reflector rim 48.

Figure 4:
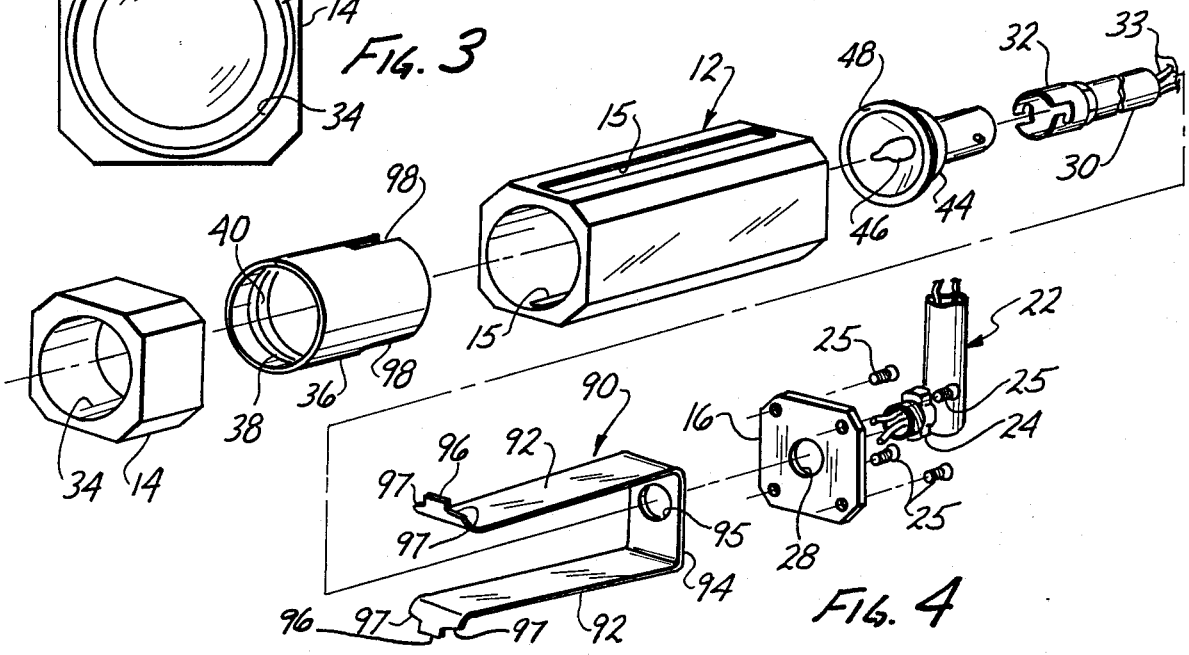
FIG. 4 is an axially exploded view of the fixture of FIG. 1.

Assembly of the light fixture 10 is further facilitated because the mounting swivel (or other external mounting device) can be first assembled to the rear panel 16, the spacer tube 30, and lamp socket 32 to make a prewired sub-assembly which can be subsequently assembled to the main housing segment 12 simply by means of the four screws 25 passing through corresponding holes 27 in plate 16 and threaded into corresponding axially oriented holes in the rear of segment 12 as indicated in FIG. 4, so that the spacer 30 is axially fixed in bore 34 of the housing segment 12. The aforementioned prewired subassemblies can be kept in inventory by the retailer who can then custom assembly fixtures for each customer. The same sub-assembly can be used with main housing extrusion segments of different ornamental finish and cross-section thereby minimizing the number of parts and the number of steps necessary to assembly an inventory of assorted fixtures, even at the retail level.

As an alternative to the socket spacer 30, FIG. 9 shows the lamp socket 32 secured to the baffle tube 36 by means of a mounting U-clip 52, which is more fully seen in FIG. 10. The mounting clip 52 includes a central section 54 in which is a hole 56 between two somewhat divergent legs 58. The clip 52 is of resilient material such that the ends of the legs 58 may be squeezed together for insertion into the portion 42 of the coupler tube 36. Each leg 58 carries an end tab 60, each of which fits into a corresponding one of two diametrically opposed holes 62 in the baffle tube 36 when the clip is released and the legs 58 spread apart under inherent spring tension. The lamp socket 32 has a threaded rear stub 64 which passes through the hole 56 in the mounting clip and engages a retaining nut 66. The mounting clip 52 is dimensioned so as to hold the reflector 44 with its rim 48 against the inner shoulder 68 of the baffle 38. This shoulder is the transition between the reduced baffle aperture 40 and the larger inner diameter of baffle tube section 42. The mounting clip 52 maintains the reflector rim securely seated against the shoulder 68 and the reflector rim 48 is further held against radial movement by the wall portion 42 of the baffle tube. Access to the lamp 46 and reflector 44 in the FIG. 9 arrangement is as convenient as that in previously described embodiments. The baffle holder segment 14 is pulled axially off the end of the main housing segment 12 carrying with it the socket 32 which however remains connected to conductors 33 which are threaded through external mount 18' in a manner described in connection with FIG. 2. The clip 52 is readily separated from the baffle holder segment 14 by squeezing together the legs 58 to withdraw the tabs 60 from baffle tube hole 62, and then removing the reflector and socket assembly from the baffle tube 36.

Figure 5:
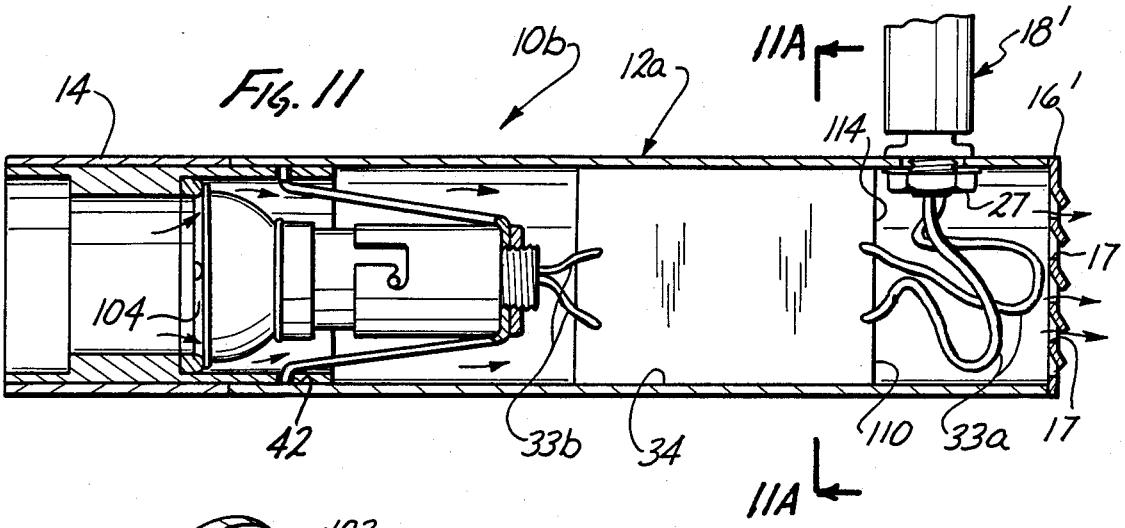
FIG. 5 is a perspective view of a variation of a spacer ring which may be optionally inserted into the lighting fixture of this invention or other lighting fixtures to create a ventilation opening at the front baffle of the fixture.
Figure 5:
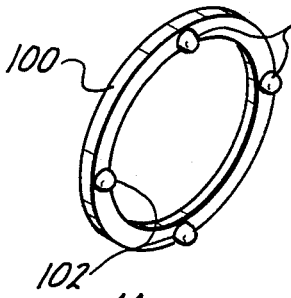

A spacer ring 100 best seen in perspective view in FIG. 5, has four hemispherical axial protuberances equally circumferentially spaced on one of its sides, and is interposed between the baffle tube shoulder 68 and the reflector rim 48 as seen in FIG. 9. The four protuberances 102 maintain the reflector rim 48 spaced away from the ring 100 as well as away from the baffle shoulder 68, thus defining a circumferential gap 104 between the reflector and the ring, allowing air flow between the ambient atmosphere through the baffle opening 40 and the bore 34 of the housing segment 12. In the absence of the spacer ring 100, the reflector rim 48 is seated circumferentially against the annular baffle shoulder 68 closing the baffle opening 40 to any air flow into the housing bore 34.

In providing the spacer ring 100 advantage is taken of the spring normally built into standard bayonet-type lamp sockets such as socket 32, where the spring force serves to seat the contact point 106 on the base of the lamp 46 seated within the receiving slot 108 in the socket 32. Thus, the spacer ring 100 can be added to a fixture 10 constructed such that the reflector rim 48 is supported by the mounting clip 52 or other equivalent socket supporting element, directly against the baffle shoulder 68. The built-in spring action of the bayonet socket 32 allows retrofitting of a spacer ring such as 100 for opening up a ventiltion gap between the reflector and the baffle.

It is contemplated that a spacer ring 100 may be retrofitted to a variety of existing lighting fixtures which may differ from the fixtures described and illustrated in this specification but which nevertheless include a reflector mounted against a baffle so as to normally prevent air flow through the baffle opening into the interior of the lamp housing, and in which the reflector/-lamp assembly mounting arrangement is capabale of yielding away from the baffle to permit insertion of a spacer ring so as to maintain a ventilation aperture into the lamp housing.

A rear end panel 16' with louvered slots in cooperation with the front baffle ventilation gap 104 allows continuous flow-through passive ventilation of the housing 10 as suggested by the flow arrows, driven by the tendency of the heated interior air to rise. In most cases the housing segment 12 will be oriented at a downward angle, hot air within the bore 34 will tend to flow through the elevated rear end panel 16' and cool ambient air will be drawn in through the baffle ventilation gap 104. In installations where the baffle end of the fixture is elevated, reverse air flow may occur and is equally effective in dissipating internal heat.

The mounting clip 52 may be employed in a slotted, side-baffled housing such as in FIGS. 1–4 by eliminating the spacer 30 and providing a suitable fastener, adhesive or weld for affixing the base 94 of the U-strip 90 to the end panel 16'. In such case, the U-strip should occupy a plane transverse to that of the mounting clip 52, with the aforementioned openings 62 and slots 98 provided in the coupler tube 36 at 90 degrees from each other.

Figure 6:
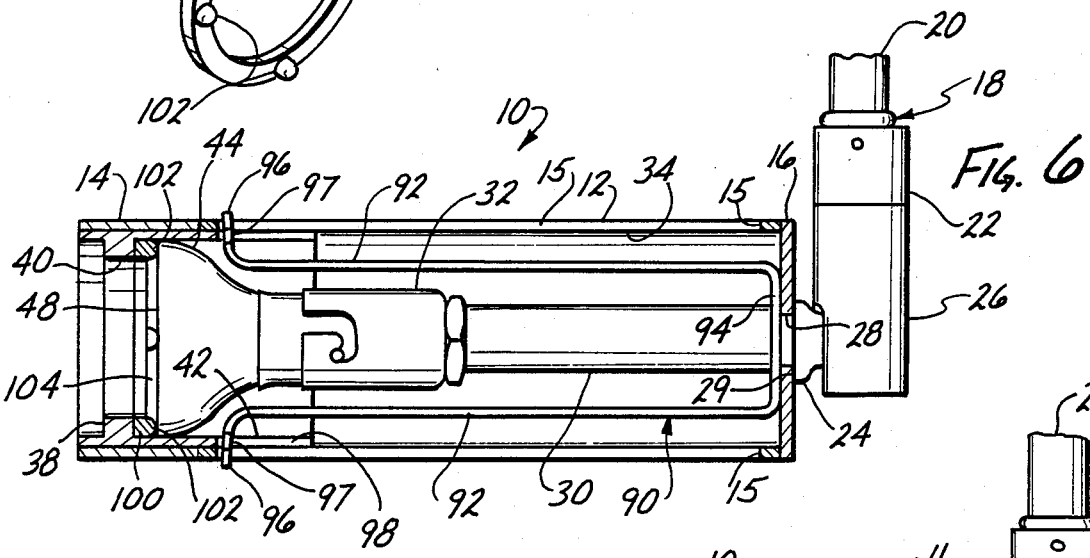
FIG. 6 is a longitudinal cross section taken in elevation of the the fixtures of FIGS. 1 through 4 but provided with the spacer ring of FIG. 5.

FIG. 6 shows a lighting fixture 10 which is similar to that shown in FIGS. 1 through 4, but which has been provided with a spacer ring 100 inserted between the reflector rim and baffle shoulder as described in connection with FIG. 9. The resultant baffle ventilation gap 104 thus cooperates with the side ventilation slots 15 for additional air flow through the interior of the lamp housing.

Figure 7:
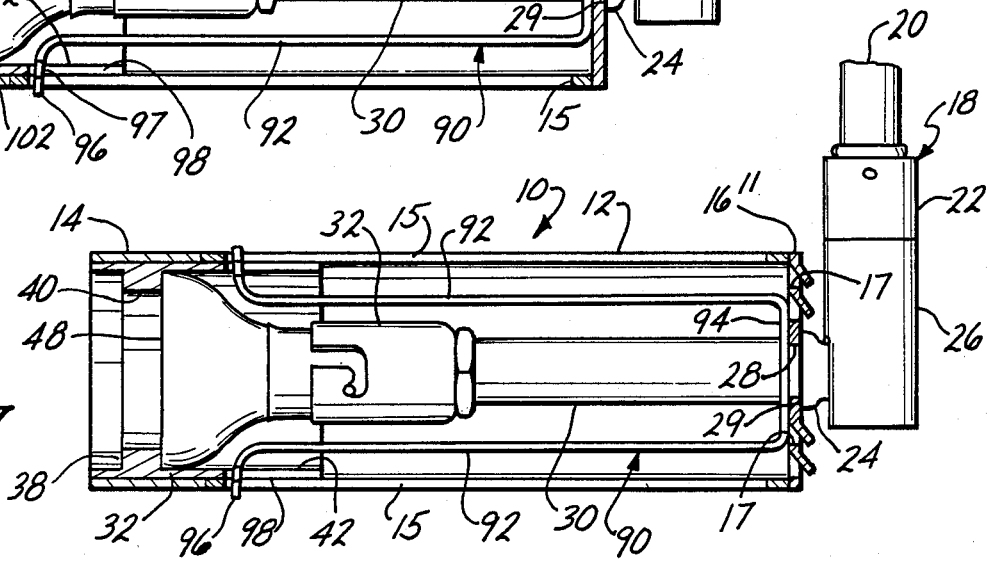
FIG. 7 is a view as in FIG. 6 wherein the fixture has been further provided with a louvered rear end panel to provide for flow-through ventilation of the fixture.

FIG. 7 shows a fixture 10 which is similar to that of FIGS. 1 through 4 but wherein the closed end panel 16 of FIG. 2 has been replaced by a louvered end panel 16'' which cooperates with the side ventilation slots 15 to admit additional air flow through the lamp housing. Further, the spacer ring 100 in FIG. 6 may be combined with a louvered rear end panel 16'' of FIG. 7 so as to provide both axial and transverse flow-through paths in the housing segment 12.

Figure 11A:
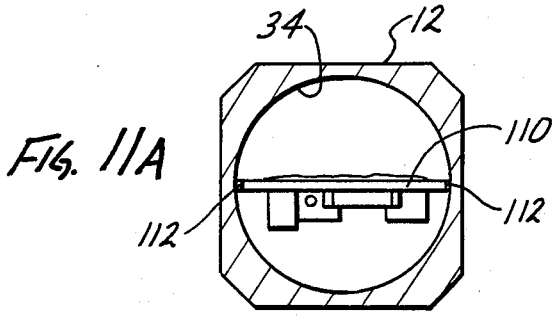
FIG. 11A is an axial cross-section taken along line 11A—11A in FIG. 11.

The high intensity halogen lamp bulbs contemplated for use with the housings of this invention typically require a low voltage/high current electrical power source, and consequently the AC household line voltage must be stepped down for powering these light sources. FIG. 11 shows a lamp housing **10*b* which is similar to the fixture 10*a* of FIG. 9 but in which the housing segment 12*a* has been extended to provide space for an internal solid state stepped-down power transformer 110, which typically may consist of a rectangular printed circuit board with two power input connections 33*a* and power output connections 33*b* between which are connected various active and passive electronic components which affect the stepped-down voltage function and deliver the necessary low-voltage high-current supply at the output conductors 33*b*. The printed circuit board of the transformer 110 is of electrically nonconductive material, typically glass-epoxy material and the four edges of the rectangular board are nonconductive, with conductive circuit paths printed onto one or both sides of the circuit board as is well known. It has been found that such a solid state transformer can be fitted into the cylindrical bore 34 of the housing segment 12*a*, as shown in the cross section of FIG. 11*a* if the width of the circuit board of transformer 110 is approximately equal to the diameter of the bore 34 so as to make a snug sliding fit thereinto. The transformer board 110 is adequately held against axial displacement within the housing bore 34 by the input and output conductors 33***a* and 33*b*, in addition to a desirable friction fit between the transformer board and the bore wall 34. Rotational displacement of the transformer 110 within the cylindrical bore 34 is of no consequence from an electrical hazard aspect, nor is any danger posed by possible axial displacement along the bore 34, even if resulting in contact between the board 110 with either the lamp socket 32 or with the retaining nut 27 of the swivel unit 18', or even with the end panel 16', since the transverse edges 114 of the transformer board 110 are likewise of electrically nonconductive material. The various electronic components mounted on the transformer board 110 are held in spaced relationship with the wall of the housing bore 34 and securely away from any electrical contact with the same. Furthermore, the board, as well as the electronic components, is suspended directly within the air flow path established between the baffle vent gap 104 and the louvered rear end panel 16', such that air flows over both sides of the transformer board 110 to cool the transformer components and dissipate heat accumulation within the fixture 10*b* generated both by the lamp bulb and the power transformer. This arrangement provides a simple economical solution to the problem of housing and cooling the stepped down power transformer required by low voltage halogen light sources. As can be seen, the transformer 110 requires no mounting components and the sole modification to the fixture of FIG. 9 is the elongation of the housing segment 12 to accommodate the transformer unit.

Figure 17:
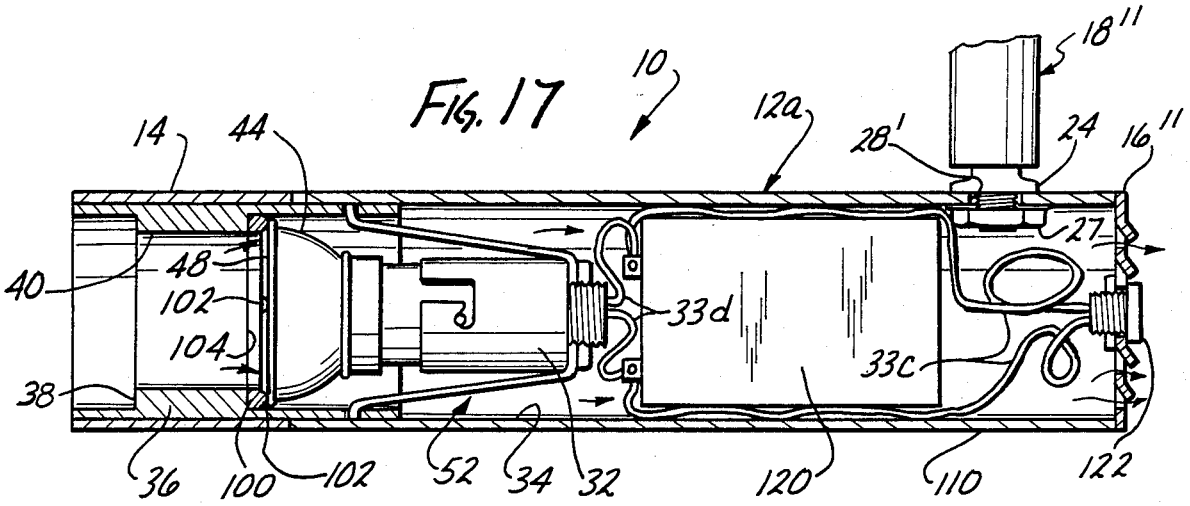
FIG. 17 is an elevational cross section of a fixture as in FIG. 11 provided with an internal rechargeable battery pack.

For portable lighting applications, such as in video recording equipment, the fixture of FIG. 17 is provided with an internal rechargeable battery pack 120 connected to the lamp socket by conductors 33*d* and a battery charging socket 122 mounted e.g. to the end panel 16" and connected to the battery pack by conductors 33*c*. An external charger unit (not shown) may be connected to the socket 122 for periodic recharging of the battery. The battery pack may have an oval cross-section or other suitable cross-section so as to leave air-flow passages between it and the housing extrusion 12*a* communicating the front baffle vent gap 104 with the louvered rear end panel 16". The swivel " may be adapted for attachment to a video camcorder, film camera, or any other equipment requiring illumination. Both the build-in power transformer and the internal battery pack options described above may be provided in the various fixtures shown and described herein, whether ventilated by side baffles, by axial flow-through or both.

Various lighting control features, illustrated in FIGS. 13 through 15, may be added to the previously described fixtures of this invention. In FIG. 13, the baffle holder segment 14*a* has been slotted in an axially transverse plane through the full diameter of the baffle aperture 40 but stopping short of cutting completely through the extrusion. The slot 70 thus formed permits insertion of a color gel filter sheet 72 in front of the reflector 44 so as to give the light emitted by the fixture any desired color. In addition to color filters other optical elements such as polaroid sheets, ultraviolet or infrared filters, etc., may be inserted in the slot 70 of the holder segment 14*a*. The slotted baffle holder segment 14*a* is thus a filter module and provides an easy convenient and inexpensive means of holding a wide variety of low cost filters which may consist merely of sheet material cut to an appropriate size and shape for insertion into the filter holder slot 70. No particular brackets, frames or other retaining elements are needed for the filter materials.

FIG. 14 shows a fixture constructed according to any of the embodiments described or illustrated, wherein the baffle holder segment 14*b* has been provided with an iris diaphragm 74. The diaphragm is mounted within the bore 34 of the baffle holder segment in lieu of baffle 38 by any convenient means as for example between two tube sections adhesively fixed withn the bore 34 of baffle segment 14*b* on each side of the iris 74 so as to hold the latter axially in place. The iris is of a commercially available type used in light projectors and the like and includes an iris control lever 76 which extends through a slot 78 machined in the holder segment 14*b*, allowing the aperture of the iris 74 to be manually adjusted by sliding the lever 76 between the two ends of the slot 78. The iris 74 is typically placed at one focal point of a focusing lens 80 mounted within the bore 34 of the segment 14*b* ahead of the iris 74 such that an image of the iris aperture is projected by the fixture and a well defined circular spotlight effect is obtained. The segment 14*b* provided with iris 74 and lens 80 is thus a spotlight module readily interchangeable with a filter holder segment 14*a* of FIG. 13 or the baffle holder segment 14 of e.g. FIGS. 1 through 11.

FIG. 15 shows a barn door module comprised of holder segment 14*c* provided with a so-called barn door arrangement 82 which includes four trapezoidal shades 84 hinged to the front end of the extrusion segment 14*c* along each of the four sides 85 of the segment end. Each shade 84 may be independently adjusted so as to limit the light projected by the fixture to a particular area to be illuminated.

Each of the holder segments or modules 14*a*, 14*b* and 14*c* in FIGS. 13 through 15 includes a coupler tube segment equivalent to tube segment 36 in FIGS. 1 through 4 which allows the various modules to be interchangeably fitted to the front end of the main housing segment 12 while at the same time receiving and holding the reflector/lamp assembly 42 within the coupler tube in a manner earlier described. It is also within the scope of this invention to provide for stackable holder segments whereby, for example, a spotlight module 14*b* may be fitted onto the front end of a filter segment 14*a*, or a barn door holder segment 14*c* fitted over a filter segment 14*a*. The stacking of the holder segments is by means of the coupler tube segment 42 extending from the rear of one holder segment 14 and fitting into the front end of the other holder segment 14.

The main housing segment 12 and baffle holder segment 14 are preferably made of extruded aluminum for a lightweight but durable fixture housing 10 which can readily take on a variety of electroplated or otherwise applied finishes.

The ornamental appearance of the light fixture can be easily varied to suit different tastes and interior decors. The exterior surfaces of the main housing segment 12 and the baffle holder segment 14 can be finished in a variety of available metal finishes including flat black, chrome, bronze, etc., with complementary or contrasting exterior finishes, colors or textures between the two segments 12 and 14. Of particular interest to interior decorators is the flexibility inherently provided by the easy interchangeability of the baffle holder 14. For example, the baffle holder 14 can have a black exterior finish while the tube body 12 is chrome plated (or vice-versa) for an attractive cntrast between the two. The appearance of each fixture may be readily changed and adapted to particular tastes and requirements merely by interchanging differently finished baffle holders 14, even after the fixture has been installed, quickly and easily by merely pulling off an existing baffle holder and inserting a new one without use of any tools or special skills.

If desired, a mounting unit 18' can be attached to the main housing segment 12 at an intermediate point as shown in the modified fixture 10' of FIGS. 8 and 9, rather than at the rear end of the segment 12. In such modification, the threaded stub 24 of the mounting 18' is secured through a hole 18' in one of the side surfaces of the segment 12, allowing both vertical and horizontal pivoting of the lamp housing. The rear end of the hollow spacer 30 is fixed to the rear panel 16 by a suitable fastener and one or more openings 29 un the wall of the tube 30 are provided in the spacer 30 to admit the conductors 33 as shown.

For further ornamental variety, a third, intermediate extrusion segment 50 shown in FIG. 12 may be fitted over the coupler tube section 42 axially intermediate the baffle holder 14 and main housing tube 12. In this case, the exposed length 42 of the coupler tube is made sufficiently longer than the intermediate extrusion segment 50 so as to make a secure friction fit when inserted into the bore 34 of the main housing segment. The addition of an intermediate segment 50 allows for a greater number of color and finish combinations as between the three extrusion segments 12, 14 and 50 which comprise the housing 10''. By way of example, the baffle holder 14 and main housing segment 12 may be chrome plated while the intermediate segment 50 is a contrasting black finish. Many other such decorative combinations will readily come to mind. Still more variations in appearance can be had by varying the outer dimensions and cross-sectional shapes of the various segments while maintaining a common diameter of the extrusion bore 34 in each segment 12, 14 and 50 so that the extrusion segments can still be easily joined by means of a length of tubing 38 having continuous outer diameter.

Considerable economies are realized by cutting the various housing segments 12, 14 and 50 from low cost, easily fabricated continuous extrusion tubing. Still more variations in the appearance of the assembled light fixtures can be achieved by varying both the absolute and relative lengths of the various housing segments 12, 14 and 50. Longer or shorter housings 10 can be readily obtained from the same continuous extrusion, simply by varying the lengths of the baffle holder 14 and main housing section 12 without need for costly re-tooling, by minimal readjustment of production facilities to cut the continuous extrusion to different lengths. Furthermore, the continuous extrusions can be fabricated in an almost limitless variety of exterior shapes, cross-sections and designs without thereby altering the basic construction and advantageous characteristics of this novel light fixture.

Figure 16:
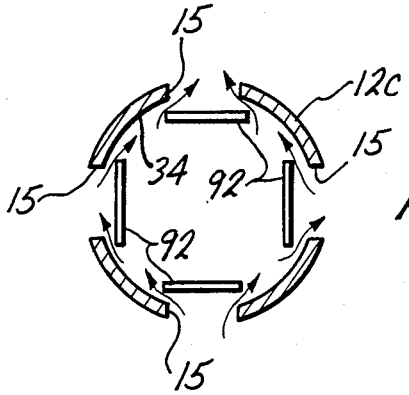
FIG. 16 is an axial cross section illustrating an alternative cylindrical housing segment with four ventilation slots and four corresponding side baffles.

As shown in FIG. 16, for example, the exterior cross section of the housing segment **12*c* may be cylindrical and may be provided with either two or, as shown, four longitudinal ventilation slots 15, each slot shielded by a corresponding side baffle 92, with typical cross-flow ventilation patterns suggested by the arrows. The four side baffles 92 required by a four-slot housing may be provided by two U-shaped baffle strips 90 such as used in the embodiment of FIGS. 1–4, the two strips being mounted with their bases 94 crossed at right angles and supported in an interference fit as illustrated in FIG. 2 between the end panel 16 and spacer 30**.

From the foregoing, it will be apparent that an attractive and versatile light fixture suitable for modern, high intensity miniature quartz-halogen lamps can be constructed from a minimum number of components which are easily and quickly assembled.

While particular embodiments of the invention have been described and illustrated for purposes of clarity and example, it will be readily apparent that many changes substitutions and modifications to the described embodiments can be made by those possessed of ordinary skill in the art without departing thereby from the spirit and scope of the prevent invention which is limited only by the scope of the following claims.

What is claimed is:

1. In a lighting fixture of the type having a housing, a lamp socket in said housing, a reflector supported on said socket for directing light emitted by a lamp fitted in said socket, and a front baffle on said housing in contact with said reflector, the improvement comprising:

spacer means interposed between said baffle and said reflector for maintaining an air flow gap therebetween for ventilating the interior of said housing.

2. The improvement of claim 1 wherein said spacer means is a ring having a plurality of axial protuberances distributed circumferentially on said ring.

3. A spacer for insertion between a reflector and a front light baffle in a lighting fixture housing comprising a ring with a plurality of axial protuberances distributed circumferentially on said ring whereby arcuate gaps are defined between said protuberances for admitting air flow between the interior of said fixture housing and the ambient atmosphere thereby to ventilate said housing.

4. A method for ventilating a lighting fixture of the type having a housing, a lamp socket in said housing, a front baffle on said housing, a light reflector supported on said socket in contact with said baffle for directing light emitted by a lamp fitted in said socket through an opening in said baffle, said reflector closing said baffle opening against air flow into said housing, said method comprising the steps of:

providing spacer means configured and dimensioned to fit between said baffle and said reflector without substantially interfering with light output through said baffle opening; and interposing said spacer means between said front baffle and said reflector for maintaining an air flow gap therebetween admitting air flow between the interior of said housing and the ambient atmosphere.

5. A light fixture comprising:

a tubular body having two open ends;

an end panel closing one said end of said body;

a baffle segment including a light baffle defining a front baffle aperture;

A coupler tube fixed within one of said baffle segment or the forward end of said tubular body for joining said baffle segment and said body in a friction fit;

a reflector mounted on an electrical lamp socket;

means urging said reflector towards said baffle; and spacer means interposed between said reflector and said baffle maintaining a ventilation gap therebetween for admitting air flow into said tubular body.

6. The light fixture of claim 5 further comprising means defining additional ventilation openings in said tubular body cooperating with said ventilation gap to provide an air flow path through said body.

7. The light fixture of claim 5 further comprising an end panel closing the rear end of said tubular body, said panel being apertured to define with said ventilation gap an air flow path through said tubular body.

8. The light fixture of claim 5 further comprising;

one or more longitudinal slots in said tubular body; and side baffle means supported within said body shielding said slot against stray light emitted by said lamp said one or more slots defining with said ventilation gap an air flow path through said housing.

9. The light fixture of claim 5 wherein said means urging said reflector include spring means on said lamp socket.

10. A light fixture comprising:

a tubular body having two open ends and a continuous bore therebetween;

a plurality of longitudinal ventilation slots in said body for admitting air flow across said bore;

an end panel removably closing one said end of said body;

side baffle means supported on said end panel for shielding said ventilation slots against emission of stray light from said bore;

a lamp socket supported at the opposite open end of said body;

a reflector mounted to said socket; and front baffle means including a coupler tube insertable into the open forward end of said tubular body for supporting said front baffle means to said body in a friction fit with said coupler tube, said coupler tube receiving and securing said reflector and said socket against lateral movement.

11. The fixture of claim 10 further comprising spring clip means supporting said socket to said coupler tube, said spring clip and socket being removable from said coupler tube upon separation of said front baffle means and housing segments for replacement of a lamp fitted in said socket.

12. A light fixture comprising:

an extruded tubular housing segment having two open ends and an axial bore between said ends;

first means closing one said end of said housing segment;

second means supporting a lamp socket;

a reflector mounted on said socket;

an extruded baffle segment;

a coupler tube fixed within to said baffle segment and slidable into the open end of said housing segment for joining the two segments while receiving and supporting said reflector against lateral movement within said axial bore;

fixture mounting means including electrical supply conductors attached to said housing segment, said supply conductors passing through an opening in said housing segment; and solid state power transformer means including electrically nonconductive means dimensioned to fit closely within said bore cross-section and be held therein against lateral movement, said transformer means further having a power input connected to said supply conductors and a power output connected to said socket.

13. The light fixture of claim 12 wherein said non-conductive means include a circuit board having a width substantially equal to the diameter of said bore and held transversely therein.

14. A light fixture comprising:

a housing comprised of two or more tubular segments, a fixture mount connected to a first of said segments, said mount including electrical power conductors through said mount and into said first segment;

a coupler tube fixed within a second of said segments and partially extending therefrom;

said extending portion fitted into said first segment for axially joining said first and second segments in a frictional retentive fit;

lamp socket means electrically connected to said power conductors;

a lamp/reflector assembly mounted in said socket means and supported within said coupler tube, said reflector having a reflector rim slightly undersized in relation to the inside diameter of said coupler tube such that said reflector/lamp assembly is held against lateral movement within said coupler tube; and spring clip means supporting said socket means to said coupler tube, said spring clip having resiliently spreadable legs terminating in leg ends engaged in corresponding openings in said coupler tube such that said socket means is manually removable from said coupler tube upon separation of said first and second segments for access to said lamp.

15. The housing of claim 14 further comprising solid state power transformer means dimensioned to fit within said first segment, said transformer means further having a power input connected to said supply conductors and a power output connected to said socket.

16. The light fixture of claim 15 wherein said first tubular segment has a cylindrical bore and said transformer means include non-conductive means dimensioned to fit closely within said bore to hold said transformer means against lateral movement therein, said transformer means being restrained against longitudinal movement along said bore by conductors connected to said power inputs and power outputs thereby to prevent electrical contact between any conductive portions of said transformer means and said housing.

17. The housing of claim 16 wherein said non-conductive means include a circuit board on which are mounted electrical components of said transformer means, said circuit board having a width substantially equal to the diameter of said bore and held transversely therein such that said electrical components are supported in said bore away from contact with said housing segment.

18. The housing of any of claims 14 through 17 wherein said first segment has a tubular wall laterally apertured for admitting airflow thereinto, and further comprising internal baffle means mounted within said first segment in spaced relationship to said tubular wall so as to substantially close the interior of said first segment to view through said lateral aperture or apertures without significantly impeding ventilation of said first segment.

* * * * *